US010208265B2

(12) United States Patent
Arafat

(10) Patent No.: US 10,208,265 B2
(45) Date of Patent: Feb. 19, 2019

(54) HIGH PERFORMANCE LUBRICATING COMPOSITIONS

(71) Applicant: El Sayad Arafat, Leonardtown, MD (US)

(72) Inventor: El Sayad Arafat, Leonardtown, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/026,419

(22) Filed: Jul. 3, 2018

(65) Prior Publication Data

US 2018/0371349 A1 Dec. 27, 2018

Related U.S. Application Data

(63) Continuation-in-part of application No. 15/416,129, filed on Jan. 26, 2017, now abandoned, which is a continuation-in-part of application No. 14/591,118, filed on Jan. 7, 2015, now abandoned.

(51) Int. Cl.

| | |
|---|---|
| ***C10M 169/04*** | (2006.01) |
| ***C10M 107/10*** | (2006.01) |
| ***C10M 133/12*** | (2006.01) |
| ***C10M 135/10*** | (2006.01) |
| ***C10M 145/14*** | (2006.01) |
| ***C10M 147/04*** | (2006.01) |
| ***C10M 127/02*** | (2006.01) |

(52) U.S. Cl.

CPC ..... *C10M 107/10* (2013.01); *C10M 127/02* (2013.01); *C10M 133/12* (2013.01); *C10M 135/10* (2013.01); *C10M 145/14* (2013.01); *C10M 147/04* (2013.01); *C10M 169/044* (2013.01); *C10M 2203/022* (2013.01); *C10M 2207/10* (2013.01); *C10M 2213/04* (2013.01); *C10M 2219/044* (2013.01); *C10N 2210/02* (2013.01); *C10N 2220/022* (2013.01); *C10N 2230/06* (2013.01); *C10N 2230/10* (2013.01); *C10N 2230/12* (2013.01); *C10N 2230/76* (2013.01)

(58) Field of Classification Search

CPC ..... C10M 147/04; C10M 169/044

See application file for complete search history.

(56) References Cited

U.S. PATENT DOCUMENTS

2007/0298990 A1* 12/2007 Carey ..... C10M 111/04 508/591

OTHER PUBLICATIONS

MIL-PRF-32033A, Feb. 16, 2016, http://www.everyspec.com.

* cited by examiner

*Primary Examiner* — Taiwo Oladapo

(74) *Attorney, Agent, or Firm* — Mark O. Glut; NAWCAD

(57) ABSTRACT

An oleaginous corrosion-resistant lubricating composition comprising at least one poly-alpha olefin synthetic oil and effective amounts of metal salts of sulfonic acids, metal salts of carboxylic acids, metal salts of mixtures of said sulfonic and carboxylic acids, alkylated aromatic stabilizers as solubility modifiers, pour-point depressants, at least one antioxidant, triazole deactivator compounds and fluoroacrylate copolymers.

18 Claims, No Drawings

HIGH PERFORMANCE LUBRICATING COMPOSITIONS

CROSS-REFERENCE TO RELATED APPLICATIONS

This Application is a Continuation-In-Part of U.S. patent application Ser. No. 15/416,129, filed Jan. 26, 2017 (PAX 247).

STATEMENT OF GOVERNMENT INTEREST

The Invention described herein may be manufactured and used by or for the Government of the United States of America for government purposes without the payment of any royalties thereon or therefore.

FIELD OF THE INVENTION

This invention relates to lubricating compositions and to methods of using said lubricating compositions that are applied by spraying or brushing onto metal parts for long-term protection to minimize environmental effects particularly on aircraft parts. High performance, long lasting, preservative lubricating oils have been developed for use in internal airframe applications in the military fleet to reduce the cost of corrosion maintenance and to improve the fleet's readiness. This invention is focused on optimizing a blend of synthetic oils, corrosion inhibitors, antiwear agents, pour-point depressants, antioxidants and other additives to form high performance lubricating oils. Lubricating oils generally comprise a majority of base oil with a variety of chemical additives to impart improved properties. The novel lubricating oils of this invention are intended for lubrication and protecting against corrosion of aircraft parts, certain small arms and automatic weapons, and whenever a general purpose, water-displacing, low-temperature lubricating oil is required.

Lubricants are typically used to separate moving part systems. This lubricating oil has the benefit of reducing friction and surface fatigue, together with reduced heat generation, operating noise, and vibrations of moving parts. Currently, several formulations have been developed and tested on military requirements of the MIL-PRF-32033A specification and corrosion-prevention properties. Based on the test results, the novel oil formulations have shown superior performance compared to the existing MIL-PRF-32033A oil products.

BACKGROUND OF THE INVENTION

Aircraft and other weapon systems are old, and structural damage from corrosion is a life-limiting factor on some of these aircraft. One of the factors contributing to corrosion is that existing preservative lubricating oils have not proven to be effective for more than a few days or weeks and therefore require repeated applications. The MIL-PRF-32033A specification is currently used by DoD services as a preservative lubrication oil to maintain aircraft. MIL-PRF-32033A is a specification of a general purpose, water-displacing, lubricating oil with preservative properties, and is intended for the lubrication and preservation of aircraft components. The oil is used as a general-purpose lubricant in all applications where water displacement, water-resistance, corrosion protection and/or low temperature performance is required.

The NAVAIR Corrosion Fleet Focus Team has indicated that the corrosion protection of the current lubricating oils is not sufficient and requires repeated applications. The goal of this invention is to develop high-performance general-purpose lubricating oil products, per MIL-PRF-32033A, to reduce the maintenance cost and meet the fleet needs. This invention will benefit the Naval Aviation Enterprise (NAE) by providing a more efficient, cost effective and high performance lubricating oil for aerospace applications. The cost savings will be realized through reduced maintenance costs and enhanced mission readiness.

SUMMARY OF THE INVENTION

More specifically, this invention relates to oleaginous or lubricating oil compositions consisting essentially of one or more poly-alpha olefin synthetic lubricating oils having a viscosity requirement that meets the specification of MIL-PRF-32033A. The synthetic lubricating oil comprise effective amounts of metal salts consisting of sulfonic acids, carboxylic acids, and combinations of said metal salts, pour-point depressants comprising hydrotreated distillate heavy-paraffinic additives, one or more antioxidants such as the aromatic amines, metal deactivation, alkylated aromatic stabilizers and water repellants.

It is an object of this invention to provide oleaginous compositions to protect against corrosion or rust of small arms, automatic weapons, aircraft parts and the like.

It is another object of this invention to provide stabile oleaginous compositions resistant to corrosion.

It is a further object of this invention to provide oleaginous or oil compositions and a method of using said compositions to form a rust-resistant coating on various metal surfaces.

These and other object of the invention will become apparent by reference to the detailed description.

DETAILED DESCRIPTION OF THE INVENTION

This invention relates to oleaginous corrosion-resistant compositions and to the method of inhibiting corrosion or rust on various metal compound surfaces including metals such as aluminum, aluminum alloys and various ferrous metals. The oleaginous oil compositions of this invention consist essentially of, in parts by weight, from about 70 to 85 parts and preferably from 75 to 80 parts of at least one poly-alpha olefin synthetic lubricating oil, and various mixtures of said synthetic oils, 5.0 to 15 parts and preferably from 8.0 to 12 parts of oil soluble compounds consisting of corrosion inhibitors selected from the group consisting of sulfonic acid metal salts, carboxylic acid metal salts, and oil soluble salts mixtures derived from the stoichiometric reaction of sulfonic acids and carboxylic acids with metals of Group I and II of the Periodic Table with about 5.0 to 15 parts and preferably from 12 to 15 parts of an oil soluble alkylated aromatic compound as the stabilizer or solubility modifier, from about 0.1 to 1.0 part and preferably 0.3 to 0.5 parts of an oil soluble pour-point depressant, such as the acrylic polymers and the hydrotreated distillate heavy-paraffinic additives, from about 0.1 to 2.0 or 1.0 to 2.5 parts of at least one antioxidant, such as an aryl or aromatic amine e.g., a diphenylamine or carbamate, from about 0.1 to 0.5 or 0.1 to 0.3 parts of a metal deactivator such as the triazole or derivatives thereof and 0.05 to 1.5 parts of water repellant.

For example, the preferred corrosion inhibitors are derived from the stoichiometric reaction of at least one sulfonic acid such a naphthalene sulfonic acid and at least one carboxylic acid such as a fatty acid with of at least one metal such as calcium or barium or metal compounds to form the metal salt or metal complex of the two acids. The corrosion inhibitors are derived from the stoichiometric reaction of a metal or metal compound including the alkaline earth metals with a one or more aromatic sulfonic acids such as naphthalene sulfonic acid and at least one carboxylic acid and preferably at least one or more of both of these acids, to form the metal salts or complex of the two acids.

The sulfonates may be prepared from sulfonic acids which are typically obtained by the sulfonation of alkyl substituted aromatic hydrocarbons as those obtained by the alkylation of aromatic hydrocarbons such as by alkylating benzene, toluene, xylene, or preferably naphthalene. Specific examples of the sulfonic acids include petroleum sulfonic acids, naphthalene sulfonic acids, such as the dialkylnaphthalene sulfonic acids, wherein the alkyl group has from 1 to 12 and preferably from 7 to 10 carbon atoms, petroleum sulfonic acids, dodecylbenzene sulfonic acid, dinonylnaphthalene sulfonic acid and the like. These sulfonic acids are known in the art, and for this invention, the weight of a sulfonic acid is the molecular weight divided by the number of sulfonic acid groups.

The carboxylic acids used in preparing the carboxylic acid-metal compounds and the metal complexes include the aliphatic, cycloaliphatic, mono- and polycarboxylic acids. The aliphatic acids contain at least 1 and preferably at least 12 carbon atoms. The aliphatic carboxylic acids can be saturated or unsaturated. Specific examples of the carboxylic acids include 2-ethylhexanoic acid, linolenic acid, substituted maleic acids, linoleic acid, lauric acid, oleic acid, ricinoleic acid, palmitic acid, and mixtures of two or more carboxylic acids. The preferred carboxy acids include the fatty acids having the formulas $C_nH_{2n-1}COOH$ or $C_nH_{2n-3}$. The equivalent weight of these carboxylic acids is the molecular weight divided by the number of acid groups. The corrosions inhibitors can be prepared from a mixture, in any ratio, of the sulfonic acid and the carboxylic acid with one or more metals or metal compounds.

Preferably, the sulfonates, carboxylates and the complexes are derived from the reaction of the sulfonic acid and carboxylic acid with a metal compound such as a compound of calcium, barium, magnesium, or any other metal compound. These metal neutralizing compounds include the metal oxides, hydroxides, carbonates, bicarbonates, and mixtures thereof. These corrosion-resistant metal salts and complexes are derived from the reaction of these metal compounds with stoichiometric amounts of either one of the acids or a combination of the acids to form the metal salts of both acids or the complex of said acids.

The polyvalent metal compounds and particularly the divalent metals of Group two of the Periodic Table reacted with both the sulfonic acid and carboxylic acid results in a combination of a sulfonic acid and carboxylic acid metal salt or complex as illustrated by the following chemical structure. The acid or acid mixtures react with the metal to form a mixture or complex metal salt.

Chemical Structure

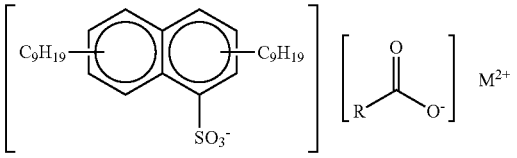

Dinonylnaphthalene Sulfonate/Carboxylate Complex

The dinonylnaphthalene sulfonate/carboxylate metal complex or compounds are derived from the reaction of stoichiometric amounts of both the sulfonic acid and the carboxylic acid with metal compounds e.g., calcium hydroxide to obtain the combined metal compounds or complex as illustrated. For example, in the combination, the sulfonic acid can range from 1 to 10 parts and the carboxylic acid can range from about 1 to 10 parts by weight.

The pour-point depressants are known as lube oil flow-improvers that lowers the temperature at which the fluid will flow or can be poured. Typical of these compounds which improve the flow temperature or fluidity of the synthetic oil include the dialkylfumarate/vinyl acetate copolymers, polyalkylmethacrylates, esters of methacrylic acid, and the alkylated naphthalenes. Preferably, Cristol-PPD LX-150 (Hydrotreated Distillate Heavy-Paraffinic Compounds) are used as pour-point depressant additives to meet the pour-point requirements of the MIL-PRF-32033A specification. It was necessary to add the pour-point depressant to the formulation to improve the oil's performance at low temperatures (−40° C.). The pour-point depressant is added to the corrosion-resistant compositions in amounts ranging from about 0.1 to 1.0 parts by weight, and preferably from about 0.3 to 0.5 parts.

The following formulations show the high-performance lubricating compositions of examples one through six.

Lubricating Oil Compositions

Example 1

| | | Parts by weight |
|---|---|---|
| (a) | Synfluid PAO −2 cST (Boiling Point 223° C.)<br>(Poly-Alpha Olefin-Synthetic Fluid, Base Oil)<br>(1-Decene, Dimer homopolymer, hydrogenated)<br>And/Or<br>Synfluid PAO −4 Cst (Boiling Point 414° C.)<br>(Poly-Alpha Olefin-Synthetic Fluid, Base Oil)<br>(1-Decene, homopolymer, hydrogenated) | 70-85<br>or<br>75-80 |
| (b) | NA-SUL CA -HT3 (Corrosion Inhibitor)<br>(Calcium Dinonylnaphthalenesulfonate/Carboxylate)<br>(Stoichiometric Reaction of the sulfonic and carboxylic acids with calcium compounds) | 5-15<br>or<br>8-12 |
| (c) | Cristol-PPD LX-150<br>(Hydrotreated distillate heavy paraffinic compound<br>(Pour-Point Depressant) | 0.1-1.0<br>or<br>0.3-0.5 |
| (d) | NA-Lube K R 007A (Stabilizer)<br>(Alkylated Aromatic Additive) | 5-15<br>or<br>12-15 |
| (e) | NA-Lube AO-130<br>(Nonylated Diphenylamine, Antioxidant)<br>NA-Lube AO-242 and/or<br>(Butylated, octylated diphenylamine, Antioxidant)<br>NA-Lube ADTC (and/or)<br>(Methylene-bis-(dibutyldithiocarbamate, Antioxidant) | 0.1-2.0<br>or<br>0.1-1.5 |
| (f) | K-CORP ® NF-200<br>(Benzotriazole and Derivatives, Metal Deactivator | 0.1-0.5<br>or<br>0.1-0.3 |

Example 2

The composition of Example One except the corrosion inhibitor is an alkaline earth metal salt of an alkylaryl sulfonic acid.

Example 3

The composition of Example One, except the corrosion inhibitor is an alkaline earth metal salt of an aliphatic carboxylic acid.

Example 4

The composition of Example One, except the corrosion inhibitor is derived from a stoichiometric reaction of a zinc compound with a mixture, in any ratio, of a fatty acid and a sulfonic acid.

Example 5

The composition of Example One, except the corrosion inhibitor is derived from the stoichiometric reaction of an alkaline earth metal compound with a naphthalene sulfonic acid and an aliphatic carboxylic acid to obtain the sulfonic acid-carboxylic acid metal salt complex.

Example 6

| | Parts by weight (g) | Weight (%) |
|---|---|---|
| Synfluid PAO −2 cST | 35.0 | 35 |
| (Poly-Alpha Olefin-Synthetic Fluid, Base Oil | 30-40 | |
| (1-Decene, Dimer homopolymer, hydrogenated) | | |
| Synfluid PAO −4 cST | 37.0 | 37 |
| (Poly-Alpha Olefin- Synthetic Fluid, Base Oil) | 30-40 | |
| (1-Decene, homopolymer, hydrogenated) | | |
| VISCOPLEX 7-305 | 2.0 | 2 |
| (Acrylic Copolymer and hydrated distillate paraphinic compounds) (Pour-Point Depressant) | 1.0-3.0 | |
| NA-Sul CA -HT3 | 7.0 | 7 |
| (Calcium Dinonylnaphthalenesulfonate/Carboxylate) | 5-9 | |
| (Corrosion Inhibitor) | | |
| NA-Sul CA/W 1213 | 4.0 | 4 |
| (Calcium Alkylnaphthalenesulfonates) | 2-6 | |
| NA-Lube K R 007A | 12.5 | 12.5 |
| (Alkylated Aromatic Additive, Stabilizer) | 10-14 | |
| NA-Lube AO-130 | 0.5 | 0.5 |
| (Nonylated Diphenylamine, Antioxidant) | 0.4-0.6 | |
| NA-Lube AO-242 | 0.3 | 0.29 |
| (Butylated, Octylated Diphenylamine, Antioxidant) | 0.2-0.4 | |
| NA-Lube ADTC | 0.5 | 0.5 |
| (Methylene-bis-(dibutyldithiocarbamate, Antioxidant) | 0.4-0.6 | |
| K-CORP ® NF-200 | 0.15 | 0.15 |
| (Benzotriazole and Derivatives, Metal Deactivator) | 0.1-0.2 | |
| FluorN S83 (Fluoroacrylate Copolymer) | 1.00 | 1.0 |
| | 0.5-1.5 | |

Fluoroacrylate copolymers are the reaction product of a flluorochemical alcohol, at least one unbranched symmetric diisocyanate, and at least one hydroxy-terminatedalkyl (meth)acrylate or 2-fluoroacrylate monomer.

The kinematic viscosity requirements of MIL-PRF-32033A specification is specified in Table 1.

TABLE 1

| Kinematic viscosity, $mm^2/s$) | |
|---|---|
| @ 40 degrees Celsius (° C.), minimum. | 11 |
| @ −40° C., maximum. | 7,000 |
| @ −54° C. maximum. | 60,000 |

Neutral Salt Spray Test

The salt spray test for the oil compositions and various commercial products were performed in accordance with the ASTM B117 method. Table 2 shows the salt spray test results for example one compared to several commercial products qualified to MIL-PRF-32033A. The new formulation of this invention showed superior performance compared to the existing MIL-PRF-32033A products. Steel panels coated with commercial products lasted only one to two days in the salt spray cabinet compared to four (4) days for steel panels coated with example one formulation. Further, aluminum panels coated with commercial products lasted less than five days in the salt spray cabinet while panels coated with the new formulation (example one) lasted more than 14 days.

TABLE 2

| | New Formulation |
|---|---|
| FTM 5322 Corrosivity Test (240 hours) | |
| 50% relative humidity, 79° F. | Pass |
| FTM 4001.2 Salt Fog | |
| Steel | 6 days |
| Aluminum | 13 days |
| 4.2.5.5 Mil 32033 Film Characteristics | Pass |
| FTM 3458 Low Temperature Stability | Pass |
| 3.3.2.1 Mil 32033 Removability | Pass |

Example one formulations were tested to the requirements of MIL-PRF-32033A specification and showed excellent results as shown in Table (3). The results in Table (3) indicate that the formulation meets or exceeds the requirements of MIL-PRF-32033A specification.

TABLE 3

Test Results of Example One Formulations to the Requirements of MIL-PRF-32033A Specification

| Test | Method | Specification Limit | New Formulation |
|---|---|---|---|
| Viscosity | ASTM D445 | | |
| @ 40 C., cSt, min | | 11 | 13.976 |
| @ −40 C., cSt, max | | 7,000 | 1,900 |
| @ −54 C., cSt, max | | 60,000 | 11,265 |
| Pour Point, C., max | ASTM D97 | −57 | −60 |
| Low Temperature Stability, −45 C. for 72 Hours | FTM 3458 | Flow Freely | Flow Freely |
| Flash Point, C. min | ASTM D92 | 135 | 171 |
| Copper Strip Corrosion | ASTM D130 | 2a | 1a |
| Wear Preventive, max | ASTM D4171 | 1.0 | 0.43 |
| Color of finished Fluid, | ASTM D1500 | 7.0 | 2 |
| Corrosiveness of Lubricating oil to Bimetallic Couple | ASTM D1748 | No Corrosion | No Corrosion |
| Oxidation Corrosion | FTM 5308.6 | No Corrosion | No Corrosion |

The intended use of the lubricating oil composition of this invention was described in Section 6.1 of the MIL-PRF32033A specification. The lubricating oil composition is intended for lubrication and protecting against corrosion of certain small arms and automatic weapons and whenever a general purpose, water-displacing, low-temperature lubricating oil is required. Oil becomes very viscous at low temperatures so that its use at temperatures below −40° C. is limited by many machine design factors and should be proved for any specific item application by testing before adoption. The availability of this composition in gas-pressurized containers will prove to be beneficial for use in areas difficult to preserve by existing procedures. This preservative oil should not be used however, to protect fuel systems and combustion chambers of engines which are preserved in accordance with standard procedures. Composition contains carboxylic acids which could react with certain metals present in the fuel system, forming soaps which could contribute to fuel filter plugging etc.

The developed preservative lubricating oil composition aims to reduce the cost of maintaining aircraft systems, and extend the life of aircraft platforms. Application of the newly developed composition will increase fleet readiness and provide significant cost savings to the end user. Expected Department of Defense benefits include decreased aircraft downtime due to fewer scheduled maintenance inspections and maintenance actions; increased aircraft availability; and reduced corrosion repair costs, hazardous materials, and maintenance man-hours.

While the specific examples have described this invention, it is obvious to one skilled in the art that there are other variations and modifications which can be made without departing from the spirit and scope of the invention as particularly set forth in the appended claims.

The invention claimed is:

1. A corrosion-preventing free-flowing lubricating composition consisting essentially of, in parts by weight of:

60 to 80 parts of two different poly-alpha olefin synthetic lubricating oils, 7.0 to 15 parts of at least one oil soluble corrosion inhibitor selected from the group consisting of sulfonic acid metal salts, carboxylic acid metal salts and salts derived from the stoichiometric reaction of mixtures of sulfonic acids and carboxylic acids with metal compounds forming a complex of the acid salts, 10 to 14 parts of at least one oil soluble alkylated aromatic stabilizer, 1.0 to 3.0 parts of a pour-point depressant selected from the group consisting of heavy-paraffinic compounds and acrylic polymers, 1.0 to 1.6 parts of at least one oil soluble antioxidant, selected from the group consisting of aryl amines and carbamates, 0.1 to 0.2 parts of a triazole deactivator and 0.5 to 1.5 parts of a fluoroacrylate copolymer.

2. A corrosion-preventing free-flowing lubricating composition consisting essentially of from about, in parts by weight, 60 to 80 parts of a poly-alpha olefin synthetic lubricating oil, 7.0 to 15 parts of a carboxylic acid metal salt, 10 to 14 parts of an oil soluble alkylated aromatic stabilizer, 1.0 to 3.0 parts of a pour-point depressant consisting of a heavy-paraffinic compound, 1.0 to 1.6 parts of an oil soluble aryl amine antioxidant, 0.1 to 0.2 parts of a triazol deactivator and 0.5 to 1.5 parts of a fluoroacrylate copolymer.

3. A corrosion-preventing free-flowing lubricating composition consisting essentially of from about, in parts by weight, 60 to 80 parts of a poly-alpha olefin synthetic lubricating oil, 7.0 to 15 parts of a complex salt derived from the stoichiometric reaction of a sulfonic acid and a carboxylic acid with a metal compound, 10 to 14 parts of an oil soluble alkylated aromatic stabilizer compound, 1.0 to 3.0 parts of a pour-point depressant consisting of a heavy-paraffinic compound, 1.0 to 1.6 parts of an oil soluble aryl amine antioxidant, 0.1 to 0.2 parts of a trizaole deactivator and 0.5 to 1.5 parts of a fluoroacrylate copolymer.

4. The composition of claim 1 wherein the free-flowing lubricant is a mixture of poly-alpha olefin oils having different viscosities and boiling points.

5. The composition of claim 1 wherein the free-flowing lubricant is a mixture of poly-alpha olefin lubricating oils having kinematic viscosity of 1,900 at −40° C.

6. The composition of claim 1 wherein the pour-point depressant consists of hydrated distillate heavy-paraffinic compounds.

7. The composition of claim 1 wherein the sulfonic acid compound is an alkaline earth metal salt of a dialkylnaphthalene sulfonic acid.

8. The composition of claim 7 wherein the dialkylnaphthalene sulfonic acid is a dialkylnaphthalene sulfonic acid metal compound wherein the alkyl group of said sulfonic acid has one to twelve carbon atoms.

9. The composition of claim 1 wherein the pour-point is an acrylic copolymer.

10. A process of preventing corrosion of metal which comprises applying an effective amount of a corrosion-preventing free-flowing lubricating composition on said metal; said composition consisting essentially of, in parts by weight, 60 to 80 parts of two different poly-alpha olefin synthetic lubricating oils, 7.0 to 15 parts of at least one oil soluble corrosion inhibitor selected from the group consisting of sulfonic acid metal salts, carboxylic acid metal salts and acid salts derived from the stoichiometric reaction of mixtures of a sulfonic acid and a carboxylic acid with a metal compound forming a complex of the said acid salts, 10 to 14 parts of an oil soluble alkylated-aromatic stabilizer, 1.0 to 3.0 parts of a pour-point depressant selected from the group consisting of heavy-paraffinic compounds and acrylic copolymers, 1.0 to 1.6 parts of at least one oil soluble antioxidant selected from the group consisting of aryl amines and carbamates, 0.1 to 0.2 parts of a triazole deactivator and 0.5 to 1.5 parts of a fluoroacrylate copolymer.

11. The process of claim 10 wherein the poly-alpha olefin synthetic oils are a mixture of synthetic oils having different viscosities and boiling points.

12. The process of claim 11 wherein the pour-point is a hydrotreated distillate heavy paraffinic compound.

13. The process of claim 10 wherein the corrosion inhibitor is an alkaline earth metal salt of an alkylnapthalene sulfonic acid.

14. The process of claim 10 wherein the corrosion inhibitor is an alkaline earth carboxylic acid metal salt.

15. The process of claim 10 wherein the pour-point is a polymethacrylic acid copolymer.

16. The process of claim 10 wherein the antioxidant is diphenylamine.

17. The process of claim 10 wherein the lubricating composition has a viscosity of 1,900 at −40° C.

18. A corrosion-preventing lubricating composition consisting essentially of:

| | Parts by Weight |
|---|---|
| Poly-Alpha Olefin-Synthetic Fluid Base Oil (1-Decene, Dimer homopolymer, hydrogenated) | 30-40 |
| Poly-Alpha Olefin-Synthetic Fluid Base Oil (1-Decene, homopolymer, hydrogenated) | 30-40 |
| Acrylic Copolymer (Pour-Point Depressant) | 1.0-3.0 |
| Calcium Dinonylnaphthalenesulfonate/ Carboxylate (Corrosion Inhibitor) | 5-9 |
| Calcium Alkylnaphthalenesulfonates | 2-6 |
| Alkylated Aromatic Additive, Stabilizer | 10-14 |
| Nonylated Diphenylamine, Antioxidant | 0.4-0.6 |
| Butylated, Octylated Diphenylamine, Antioxident | 0.2-0.4 |
| Methylene-bis-(dibutyldithiocarbamate, Antioxidant | 0.4-0.6 |
| Benzotriazole | 0.1-0.2 |
| Fluoroacrylate Copolymer | 0.5-1.5. |

* * * * *